US006170101B1

(12) United States Patent
McCloud

(10) Patent No.: US 6,170,101 B1
(45) Date of Patent: Jan. 9, 2001

(54) SEE THROUGH PROTECTIVE CRIB COVER CONSTRUCTION

(76) Inventor: Crystal Waters McCloud, 131 Browning Rd., Merchantville, NJ (US) 08109

( * ) Notice: Under 35 U.S.C. 154(b), the term of this patent shall be extended for 0 days.

(21) Appl. No.: 09/556,584

(22) Filed: Apr. 24, 2000

(51) Int. Cl.[7] ..... A47D 15/00
(52) U.S. Cl. ..... 5/424; 5/663; 5/93.1; 5/946
(58) Field of Search ..... 5/93.1, 98.1, 424, 5/663, 907, 946, 945, 97

(56) References Cited

U.S. PATENT DOCUMENTS

| | | | | |
|---|---|---|---|---|
| 3,103,669 | * | 9/1963 | Mundis | 5/98 R |
| 3,137,870 | * | 6/1964 | Fink | 5/946 X |
| 3,763,506 | * | 10/1973 | Szego | 5/93.1 |
| 3,877,090 | * | 4/1975 | Schutz | 5/946 X |
| 4,670,923 | * | 6/1987 | Gabriel et al. | 5/946 X |
| 5,291,623 | * | 3/1994 | Artz | 5/93.1 |
| 5,421,046 | * | 6/1995 | Vande Streek | 5/946 X |
| 5,533,715 | | 7/1996 | Dandrea | 256/45 |
| 5,577,276 | | 11/1996 | Nicholson et al. | 5/424 |
| 5,806,112 | | 9/1998 | Harms | 5/93.1 |
| 5,926,873 | | 7/1999 | Fountain | 5/424 |
| 5,937,458 | | 8/1999 | DeRosa | 5/424 |
| 5,960,493 | * | 10/1999 | Rhey et al. | 5/946 X |

* cited by examiner

*Primary Examiner*—Michael F. Trettel
(74) *Attorney, Agent, or Firm*—Henderson & Strum LLP

(57) ABSTRACT

A see through protective cover construction (10) for the interior of a crib (100) as defined by the crib slats (101). The construction (10) includes a padding unit (11) including four pairs of interior (21) and exterior (22) resilient padding segments provided with aligned viewing portals (23) and joined together to sandwich a length of netting fabric (30) which is stretched across each of the viewing portals, and a fitted fabric cover member (40) dimensioned to envelope the padding unit (11) and having openings surrounding the viewing portals (23). The fabric cover member (40) is provided with a cover securing unit (14) for releasably engaging the construction (10) to selected slats (101) on the crib (100).

10 Claims, 1 Drawing Sheet

SEE THROUGH PROTECTIVE CRIB COVER CONSTRUCTION

BACKGROUND OF THE INVENTION

1. Field of the Invention

The present invention relates to the field of safety barriers for cribs in general, and in particular to a mesh lined dual foam layer construction having cut outs to provide visual inspection and cross ventilation.

2. Description of Related Art

As can be seen by reference to the following U.S. Pat. Nos. 5,533,715; 5,577,276; 5,937,458; 5,926,873; and 5,806,112, the prior art is replete with myriad and diverse crib bumper constructions for lining the interior of a child's crib.

While all of the aforementioned prior art constructions are more than adequate for the basic purpose and function for which they have been specifically designed, they are uniformly deficient with respect to their failure to provide a simple, efficient, and practical protective barrier that allows a parent to visually observe their child from a distance, as well as provide for cross ventilation within the confines of the protective barrier.

Unfortunately, the prior art constructions seem to fall into two distinct classes wherein one class is devoted to providing a mesh enclosure around the interior of the crib to prevent the child's arms, legs, or head from becoming entangled in the crib slats and the other class is devoted to providing a padded barrier that surrounds the interior of the crib, but blocks the view of the parent and child.

As a consequence of the foregoing situation, there has existed a longstanding need for a new and improved see through protective crib cover construction which has netted portals for air circulation and viewing purposes formed in a padded enclosure, and the provision of such a construction is a stated objective of the present invention.

BRIEF SUMMARY OF THE INVENTION

Briefly stated, the see through protective crib cover construction that forms the basis of the present invention comprises in general, a padding unit, a viewing unit, a cover unit, and a cover securing unit.

As will be explained in greater detail further on in the specification, the padding unit includes four pairs of resilient panel segments which form a resilient rectangular shaped enclosure member and are provided with a series of aligned viewing portals in various geometric shapes and other configurations.

The netting unit may either comprise a single elongated running length of netting material or four shorter segments of netting material which are sandwiched between the resilient panel segments and stretched across the viewing portals.

In addition, the cover unit includes a rectangular shaped cover member which is fitted over the assembled padding unit and netting unit and further provided with apertures aligned with the viewing portals and being further provided with a cover securing unit for releasably attaching the construction to the slats of a crib.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
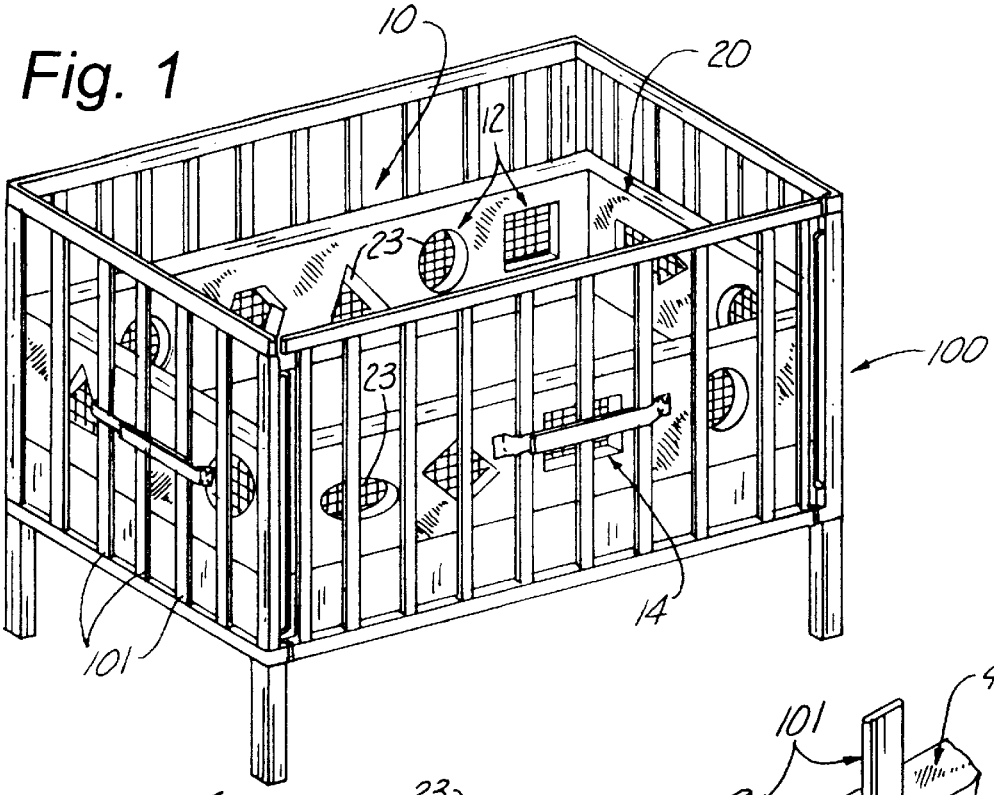
FIG. 1 is a perspective view of the see through protective cover construction installed in a child's crib.
Figure 2:
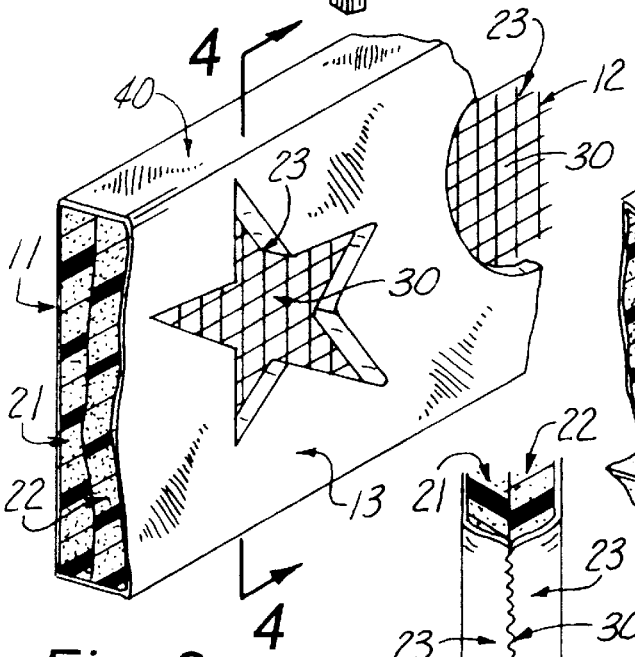
FIG. 2 is a partial cut away view of one of the panel segments of the construction.

As can be seen by reference to the drawings, and in particular to FIGS. 1 and 2, the see through protective cover construction that forms the basis of the present invention is designated generally by the reference number 10. The construction 10 includes a padding unit 11, a netting unit 12, a cover unit 13, and a cover securing unit 14. These units will now be described in seriatim fashion.

Still referring to FIGS. 1 and 2, it can be seen that the padding unit 11 comprises four pairs of resilient panel segments 21, 22. Each pair includes an interior panel segment 21 and an exterior panel segment 22 and each having a generally elongated rectangular configuration and provided with a plurality of aligned, spaced viewing portals 23 having different geometric configurations such as circles, squares, ovals, triangles, as well as other decorative configurations such as stars or the like.

In the preferred embodiment of the invention illustrated in the drawings, the resilient panel segments 21, 22 are fabricated from foam rubber or the like and each of the panel segments have a preferred thickness of approximately two inches such that the combined panel segments 21, 22 will have a sufficient stiffness and thickness to possess a stand alone capability.

Figure 4:
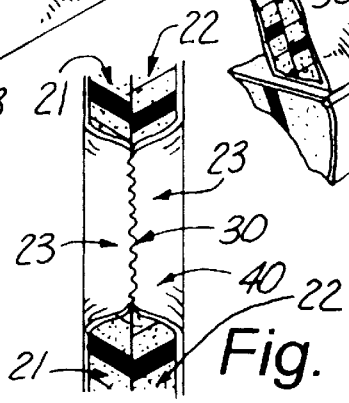
FIG. 4 is a cross sectional view taken through line 4—4 of FIG. 2.

As can best be seen by reference to FIGS. 2 and 4, the netting unit 12 comprises a length of open weave netting fabric 30 which is stretched across each of the viewing portals 23 and sandwiched between the resilient panel segments 21, 22 which may be joined together on their opposed surfaces as by adhesives or the like.

As was mentioned earlier in the specification, the netting fabric 30 may comprise either a single elongated length of netting material that runs along the length of all four pairs of panel segments 21, 22 or the netting fabric 30 could comprise four separate segments of netting material. Each segment of netting material extends a substantial distance along the length of each of the four pairs of panel segments 21, 22 which comprise the enclosure 20.

Figure 3:
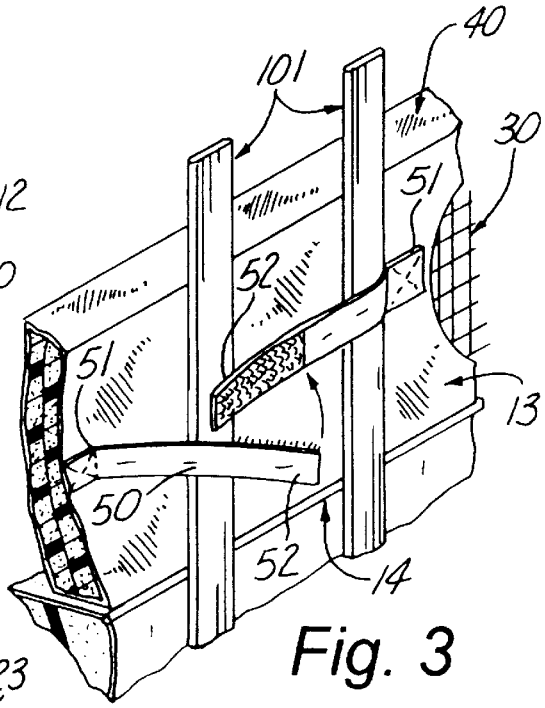
FIG. 3 is a partial cut away detail view showing the engagement of the cover securing unit with the slats of the crib.

As shown in FIGS. 2 and 3, the cover unit 13 comprises a fitted fabric cover member 40 fabricated from a suitable washable material such as nylon or the like. The fabric cover member is dimensioned to envelope the enclosure member 20 while leaving exposed the viewing portals 23 and the netting fabric windows 30.

As can be seen in particular by reference to FIG. 3, the cover securing unit 14 comprises a plurality of pairs of strap members 50 that are affixed on their outboard ends to the fabric cover member 40 at spaced locations on the outer surface of the cover member 40. The inboard ends 52 of the individual pairs of strap member 50 are provided with cooperating hook 53 and loop 54 fasteners so that the construction 10 can be releasably secured to selected slats 101 around the periphery of the crib 100 in a well recognized fashion.

By now it should be appreciated that each of the netting fabric windows 30 are spaced from the slats of the crib 100 by the thickness of the exterior resilient panel segments 22 so that a child's head, arms, or legs cannot come into direct contact with the slats or any other hard crib surface covered by the construction and that the viewing portals 23 will allow a parent to view the infant without the necessity of having to peer over the enclosure member 20.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A see through protective cover construction for the interior of a child's crib as defined by the peripheral crib slats wherein the construction comprises:

a padding unit including a generally rectangular enclosure member formed by four elongated rectangular exterior resilient panel segments wherein at least selected ones of the exterior panel segments are provided with a plurality of spaced viewing portals which extend from the exterior surface to the interior surface of the selected ones of the exterior panel segments; and a netting unit including a length of netting fabric stretched across the viewing portals on the interior surface of the selected ones of the exterior panel segments.

2. The construction as in claim 1 wherein each of the exterior resilient panel segments are fabricated from foam rubber.

3. The construction as in claim 2 wherein each of the exterior resilient panel segments have a thickness of approximately two inches.

4. The construction as in claim 3 further comprising:

a cover unit including a fitted fabric cover member dimensioned to envelope said padding unit and said netting unit and having an outer surface provided with openings aligned with the viewing portals.

5. The construction as in claim 4 further including:

a cover securing unit including a plurality of pairs of strap members wherein each pair of strap members have outboard ends secured to the outer surface of the cover member and inboard ends provided with hook and loop fasteners so as to allow each pair of strap members to releasably engage selected slats on the crib.

6. The construction as in claim 1 wherein the padding unit further comprises:

four elongated rectangular interior resilient panel segments each having interior surfaces which are affixed to the interior surfaces of the exterior panel segments to sandwich the netting fabric between the respective interior and exterior resilient panel segments on at least the selected ones of the interior panel segments which are provided with viewing portals which are aligned with the viewing portals in the selected ones of the exterior resilient panel segments.

7. The construction as in claim 6 wherein each of the interior panel segments are fabricated from foam rubber.

8. The construction as in claim 7 wherein each of the interior panel segments have a thickness of approximately two inches.

9. The construction as in claim 8 further comprising:

a cover unit including a fitted fabric cover member dimensioned to envelope said padding unit and said netting unit and having an outer surface provided with openings aligned with the viewing portals.

10. The construction as in claim 9 further comprising:

a cover securing unit including a plurality of pairs of strap members wherein each pair of strap members have outboard ends secured to the outer surface of the cover member and inboard ends provided with hook and loop fasteners so as to allow each pair of strap members to releasably engage selected slats on the crib.

* * * * *